United States Patent [19]

Hrabik

[11] 4,201,296

[45] May 6, 1980

[54] PRESERVATIVE FOR FILM

[75] Inventor: Heinrich Hrabik, Linz, Austria

[73] Assignee: Bonum-Werk Inhaber Friedrich Hetzmannseder, Linz, Austria

[21] Appl. No.: 947,533

[22] Filed: Oct. 2, 1978

[30] Foreign Application Priority Data

Aug. 7, 1978 [AT] Austria ..... 5704/78

[51] Int. Cl.[2] ..... B65D 81/24; B65D 85/67

[52] U.S. Cl. ..... 206/205; 206/539; 206/820; 312/31

[58] Field of Search ..... 206/539, 205, 204, 820; 312/31; 215/6

[56] References Cited

U.S. PATENT DOCUMENTS

| | | | |
|---|---|---|---|
| 715,273 | 12/1902 | Kohn | 312/31 |
| 2,080,066 | 5/1937 | Sheppard et al. | 206/204 |
| 2,852,326 | 9/1958 | Westlake, Jr. | 215/6 |
| 3,343,897 | 9/1967 | Keller | 312/31 |

*Primary Examiner*—William T. Dixson, Jr.
*Attorney, Agent, or Firm*—Kurt Kelman

[57] ABSTRACT

A tablet containing compacted camphor powder is sealed in a capsule.

7 Claims, 4 Drawing Figures

PRESERVATIVE FOR FILM

Figure 1:
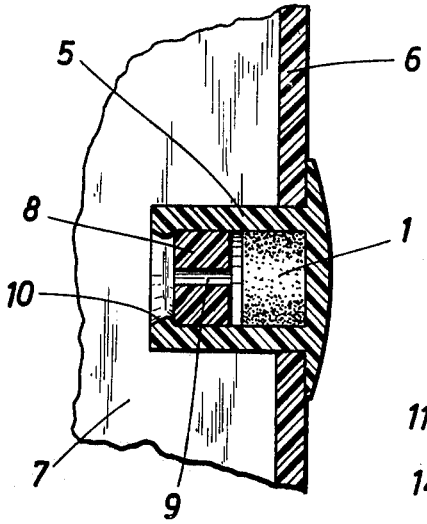

This invention relates to a camphor-containing preservative for film.

Known preservatives of that kind are made in that crystalline camphor is dissolved in alcohol. The resulting solution is used to impregnate an absorbent material. The impregnated material is subsequently sealed in small bags of aluminum foil so that the preservative can be stored. For use, the package must be pierced and placed into the film magazine so that a saturated atmosphere is soon formed in the film magazine. That atmosphere prevents a drying of the plasticizers contained in the film. As a result, the film remains pliable and is protected from bacterial attack. On the other hand, these known preservatives for film have the disadvantage that they must be loosely placed into the film magazine so that it is more difficult to remove and insert the film reel. Besides, camphor is much more volatile when dissolved in alcohol. For this reason the film magazine must be re-loaded rather often. Finally, the preservative agent is diluted by being dissolved in alcohol so that the effectiveness of the known preservatives for film is relatively small.

It is an object of the invention to provide for film a camphor-containing preservative which has a long-term activity and a high effectiveness and can be placed in a particularly desirable manner into the film magazine without adversely affecting the film reel which is to be kept in the film magazine.

This object is accomplished according to the invention in that camphor powder is compacted to form tablets and each tablet is sealed in a capsule. The compacting of camphor powder to form tablets enables a manufacture of the preservative for film at very low cost and ensures a long-term, concentrated activity.

The camphor powder can be compacted more easily if, according to a further feature of the invention, the tablets contain up to 10% by weight, preferably 5% by weight, talcum. This addition of talcum improves also the dimensional stability of the tablets.

Because the preservative for film according to the invention is available in the form of tablets, it can be used in a desirable manner to refill cartridges which have been inserted or can be inserted into a film magazine. Because the cartridges protrude into the interior of the film magazine through apertures in the magazine wall, the tablets can be held in such a manner that they do not disturb the manipulation of the film magazine and of its film reel in any manner. As camphor is volatile, the tablets must be sealed in capsules. These capsules may consist of so-called force-through packages so that the tablets for refilling the cartridges can be taken more easily. In that case it is sufficient to force the tablets through the aluminum foil which constitutes the bottom of the capsule. The use of the preservative according to the invention will be further simplified if the capsules consist of a base sheet which comprises a hollow cylindrical portion for accommodating the tablet, and a cover sheet which seals said hollow cylindrical portion. Such capsules can be fitted in corresponding apertures of a film magazine in such a manner that the sheet edges which laterally protrude from the hollow cylindrical portion constitute a sealing stop flange. The use of such capsules eliminates the need for special cartridges for holding the tablets because the capsules can be directly inserted into suitable apertures in the film magazine. The sheet edges which laterally protrude from the hollow cylindrical portion provide for the required seal between the capsule and magazine.

If the capsules are used as cartridges for holding the tablets, they must be pierced so that the preservative for film can be effective. There is a risk that the tablet is pierced and broken as a capsule is pierced. Such damage to the tablet would result in a more rapid consumption of the preservative. To prevent such damage to the tablets, a further feature of the invention resides in that the hollow cylindrical portion is provided at its end with an extension, which is clear of the tablet and has a recess at which the capsule is to be pierced. That recess serves as a guide for a piercing tool, such as a needle, by which the capsule can then be pierced at the most desirable location. Because the extension ensures that the capsule is pierced at a certain distance from the tablet, the tool which is piercing the capsule does not advance as far as to the tablet but can be retracted in time before having damaged the tablet.

If the extension is cone-shaped and the recess is located at the apex of the cone, the extension can be used to locate the tablet in the capsule if the tablet engages the wall of the cone. On the other hand, the provision of a hollow portion having a conical end wall involves the risk that the tablet placed into the hollow portion may assume an oblique position so that it is difficult to cover the hollow portions with the cover sheet. In such case, the extension may be cylindrical and provided with a central recess. If such extension does not extend throughout the end face of the hollow cylindrical portion, there will be a backing ring for the tablet between the cylindrical shell of the hollow cylindrical portion and the extension so that a proper position of the tablet in the hollow portion is ensured.

The sheets may constitute a plurality of capsules, which can be separated from each other along prepared lines of reduced strength. This feature permits of an efficient manufacture and a simple formation of supply packages, from which individual capsules can be severed when required.

Figure 2:
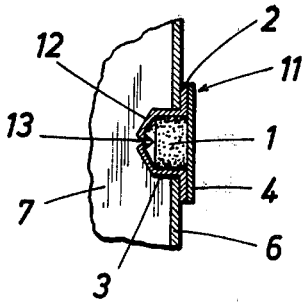

Embodiments of the invention are shown diagrammatically and by way of example on the accompanying drawing, in which FIG. 1 is a sectional view showing a retaining cartridge which extends through a wall of a film magazine and contains a preservative tablet, FIG. 2 is a sectional view taken on a different scale and showing a preservative capsule inserted into the magazine wall.

Figure 3:
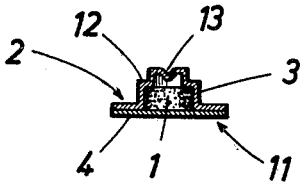
Figure 4:
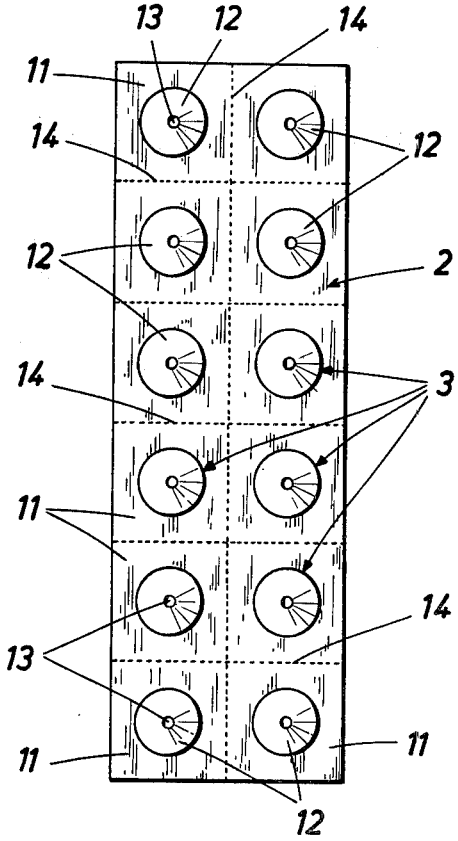

FIG. 3 is a sectional view showing a preservative capsule which differs from that of FIG. 2, and FIG. 4 is a top plan view showing a multi-capsule supply package of a preservative for film.

The preservative tablets 1 for film consist of technically pure camphor powder and in a preferred embodiment contain 5% talcum. The camphor is compacted to form tablets under a pressure of, e.g., 1000 kg/cm$^2$. These tablets are sealed in suitable capsules, which consist of a deep-drawn base sheet 2, which has a hollow cylindrical portion 3, which is sealed with a cover sheet 4. In a preferred embodiment, the deep-drawn sheet consists of polyvinylchloride sheeting and is heat-sealed to the cover sheet 4 consisting of polyamide or aluminum. For this purpose the cover sheet 4 is coated with a suitable heat-sealing lacquer. If the cover sheet 4 consists of aluminum foil, the tablet 1 can be forced through the aluminum foil out of the capsule and can then be inserted into a separate tablet cartridge 5, which is sealed in the wall 6 of a film magazine 7. The latter is not shown in more detail. The cartridge 5 has a plug 8, which is provided with a through bore 9, through which the preservative can become effective. An edge bead 10 formed on the shell of the cartridge retains the plug 8 in position.

If the cover sheet 4 consists of polyamide sheeting rather than aluminum foil, the capsule which contains the tablet 1 can be inserted in a particularly desirable manner into the magazine wall 6 because in such case the tablet cannot be simply forced out of the capsule. The sheets 2 and 4 have edge portions which laterally protrude from the hollow portion 3 to form a stop flange 11, which facilitates the sealed fitting of the capsules in the magazine wall 6.

To prevent damage to the tablets 1 as the capsules are pierced, the end walls of each hollow cylindrical portion 3 is provided with an extension 12, which is clear of the tablet 1 and formed with a recess 13, to which a needle for piercing the capsule wall can be applied to pierce the capsule wall and can be retracted before damaging the tablet. In accordance with FIG. 2 the extension 12 which is clear of the tablet is formed by a cone-shaped end wall of the hollow portion 3. In the embodiment shown in FIG. 3, the extension 12 is cylindrical and provided with a central recess 13.

A plurality of capsules can be combined in a supply package, in which the sheets 2 and 4 form a plurality of capsules, which can be individually severed from the supply package when required along prepared lines of reduced strength 14.

It is apparent that tablets which consist of compacted camphor powder and are sealed in capsules constitute a highly effective preservative for film. This preservative can be used with good results in film magazines because the tablets may be rather small and are packaged in such a manner that the preservative can be inserted into suitable apertures of a magazine wall. The tablets may be inserted into separate tablet cartridges sealed in such apertures or the capsules themselves may be used as tablet cartridges tightly fitting such apertures.

What is claimed is:

1. A preservative for protecting a film reel in a magazine, which comprises a capsule and a tablet containing compacted camphor powder, the tablet being sealed in the capsule.

2. The film reel protecting preservative of claim 1, wherein the magazine has a wall defining an aperture, the capsule is formed by a tubular portion containing the tablet and a cover sheet, the tubular portion having a laterally protruding flange and the cover sheet being sealed to the flange, whereby the flange and cover sheet form a web protruding laterally from the tubular portion, the tubular portion fitting tightly in the aperture and extending into the magazine and the laterally protruding web constituting a stop flange for sealing engagement with the magazine wall.

3. The film reel protecting preservative of claim 2, wherein the tubular capsule portion has an extended end opposite the cover sheet, the extended tubular capsule portion end defining a recess adjacent the tablet and adapted to receive a tool for piercing the capsule without touching the tablet.

4. The film reel protecting preservative of claim 3, wherein a cone-shaped end wall constitutes the extended tubular capsule portion end, the end wall having an apex during the recess.

5. The film reel protecting preservative of claim 3, wherein the extended tubular capsule portion end is cylindrical and the recess is centrally disposed therein.

6. The film reel protecting preservative of claim 1, wherein the tablet contains up to 10%, by weight, of talcum.

7. The film reel protecting preservative of claim 6, wherein the tablet contains about 5%, by weight, of talcum.

* * * * *